US011562894B1

(12) United States Patent
Kagan

(10) Patent No.: US 11,562,894 B1
(45) Date of Patent: Jan. 24, 2023

(54) ENHANCED TRACE SAMPLING SYSTEM

(71) Applicant: Avi Kagan, Mount Juliet, TN (US)

(72) Inventor: Avi Kagan, Mount Juliet, TN (US)

( * ) Notice: Subject to any disclaimer, the term of this patent is extended or adjusted under 35 U.S.C. 154(b) by 0 days.

(21) Appl. No.: 17/496,700

(22) Filed: Oct. 7, 2021

(51) Int. Cl.
*H01J 49/04* (2006.01)

(52) U.S. Cl.
CPC ..... *H01J 49/049* (2013.01); *H01J 49/0413* (2013.01); *H01J 49/0422* (2013.01)

(58) Field of Classification Search
CPC ... H01J 49/049; H01J 49/0413; H01J 49/0422
USPC ..... 250/281, 282, 283, 288
See application file for complete search history.

(56) References Cited

U.S. PATENT DOCUMENTS

2019/0362957 A1* 11/2019 Hakala ..... G01N 1/40

* cited by examiner

*Primary Examiner* — Nicole M Ippolito
(74) *Attorney, Agent, or Firm* — Michael L. Greenberg, Esq.; Greenberg & Lieberman, LLC

(57) ABSTRACT

A new form of trace sampling system which is configured to be employed in-line with a conventional conveyor-based imaging scanner, removing the need for a manual sampling substrate to be used with a mass spectrometry detection or mobility spectra detection system. The system is designed to enable rapid sampling without the need for the use of an external sampling medium such as a swab. Manifolds present within a chamber of the conveyor present evaporators and air heaters oriented towards objects to be sampled. The evaporators, via radiation, convey the sample vapor via a vacuum to a detector to analyze the vapor for selected variables.

5 Claims, 2 Drawing Sheets

ENHANCED TRACE SAMPLING SYSTEM

FEDERAL SUPPORT CLAUSE

This application was sponsored by the Department of Homeland Security Science and Technology Directorate.

FIELD OF THE PRESENT INVENTION

The present invention relates to detection systems and mechanisms, and more specifically relates to a new form of trace sampling system configured to be employed in-line with a conventional conveyor-based imaging scanner, removing the need for a manual sampling substrate to be used with a mass spectrometry detection and/or mobility spectra detection system.

BACKGROUND OF THE PRESENT INVENTION

Detection systems, such as those conventionally used by the Transportation Security Administration (TSA) at airport screening stations, are known to provide a great and relatively fast means by which explosive materials and/or elicit substances can be detected, such as on a person or within luggage. An assortment of detection systems are presently available on the market, with a vast majority of them employing a form of mobility spectrometry to facilitate the detection of target substances. All of these systems require a sample medium, such as a swab, which must be manually used to collect sample particles for detection as input for the detector.

Ideally, there would be a device on the market which is configured to sample vapors from items' surfaces and their surrounding atmosphere. Available trace detectors on the market require the use of a swab via a manual sampling operation. Presently, it is known that the use of a swab, as required by these systems, is a laborious manual operation which makes the process more cumbersome, as well as adds inherent delays to the process. If there were a way in which a detector could be instituted into the conveyor itself which could remove the need for the manual swabbing process, the detection process could be expedited and be less cumbersome to use. Additionally, if such a system could be implemented, the trace detection on items could be made to be automatic and continuous, removing the need for reset time between each sampling process.

Thus, there is a need for a new form of sampling system capable of deriving a sample directly from an item without necessitating manual sample collection via a swab by a person. Such a system is preferably configured to employ a sophisticated heater and evaporator system which is capable of uniformly heating and causing surface evaporation from the screened item, as well as the surrounding air to create sample vapors which may then be routed to a mass spectrometry detector and/or mobility spectra detector. Such a system preferably employs a synchronized heating of air conventionally, as well as radiation to obtain evaporation sufficient for detection within seconds. Additionally, such a system is preferably configured to operate in an automatic and continuous fashion.

SUMMARY OF THE PRESENT INVENTION

The present invention is a is a sampler which replaces the human sampling operation conventionally required by conventional detection systems. The present invention embodies a new system which includes localized air heating, localized evaporation, and localized vapor collectors, removing the need for a sample to be taken manually via a swab. The present invention is configured to heat the air slightly and uniformly to maintain a uniform field while an evaporation operation takes place.

The sampler of the present invention collects vapors which are available in a screened space. Preferably, the screened space is housed within a conventional imaging conveyor scanner. Similarly, the present invention can be used with regular industrial conveyors, or without a conveyor if desired. The vapors collected within the screened space are evaporated from traces of particles or liquids or both. The evaporation concept is different than usual evaporation since it is only the surface of the trace which is evaporated while the remaining mass remains intact. In contrast to the system of the present invention, conventional detectors employ evaporation to evaporate the whole mass of the trace. There is no human operation involved in the collection required by the system of the present invention, and the sampling is done on the actual item that is screened.

The system of the present invention may be paired with most conventional detectors, namely those employing mass or mobility spectrometry detectors, which is capable to operate with the sampler. In other words, commercial detectors are presently operating in batches. A staff member collects a sample manually, and a detector evaporates it, senses it, and then the detector is cleaned prior to the next test. In contrast, the sampling concept of the present invention is continuous and therefore, the detector line mass spectrometer must be able to operate continuously. It should be noted that the present invention does not deal with detector improvement; rather, it is solely configured to provide an automatic continuous sampling operation which does not require any human operation.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

The following brief and detailed descriptions of the drawings are provided to explain possible embodiments of the present invention but are not provided to limit the scope of the present invention as expressed herein this summary section.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

The present invention will be better understood with reference to the appended drawing sheets, wherein.

DETAILED DESCRIPTION OF THE PREFERRED EMBODIMENT

Figure 1:
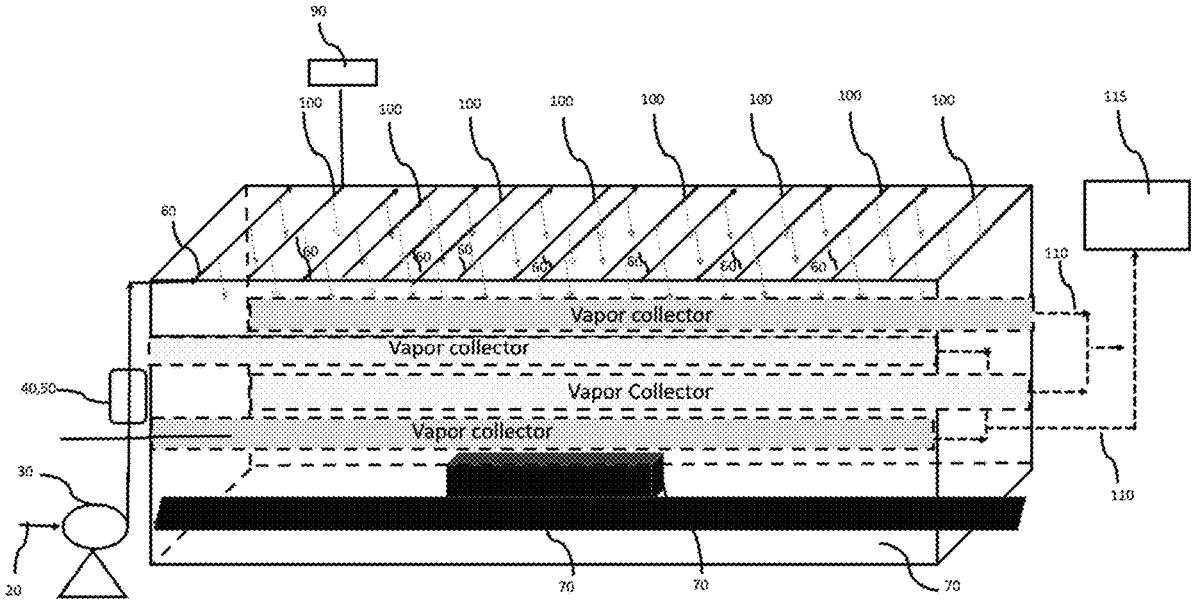
FIG. 1 shows a schematic detailing the implementation of the system of the present invention as integrated into a conventional conveyor assembly as seen from the side.

The present specification discloses one or more embodiments that incorporate the features of the invention. The disclosed embodiment(s) merely exemplify the invention. The scope of the invention is not limited to the disclosed embodiment(s).

References in the specification to "one embodiment," "an embodiment," "an example embodiment," etc., indicate that the embodiment described may include a particular feature, structure, or characteristic, but every embodiment may not necessarily include the particular feature, structure or characteristic. Moreover, such phrases are not necessarily referring to the same embodiment, Further, when a particular feature, structure, or characteristic is described in connection with an embodiment, it is submitted that it is within the knowledge of one skilled in the art to affect such feature, structure, or characteristic in connection with other embodiments whether or not explicitly described.

The present invention is a supplemental system for use with mass spectrometry detection mechanisms to facilitate the detection of trace elements for use in screening operations. The system of the present invention is configured to enable trace detection in an automatic and continuous fashion, capable of trace sampling directly from the screened items. The preferred embodiment of the present invention includes three sub-systems: 1) A controlled air heater system, 2) A controlled evaporation system, and 3) Vapor collectors. At least one Programmable Logic Controller (PLC) or set of individual timer programmable switches is configured to manage the three subsystems of the present invention. It should be noted that the PLC may be integrated in order to enable the continuous operation in which the three sub-systems may operate in a synchronized fashion. The PLC may be integrated with, or managed by, preexisting process management hardware of the detector and/or imaging scanner of the operation. The sampler's output which is sent to the detector is detected without any further control from the sampler itself, but rather from the detector's control arrangement. The PLC of the present invention may be synchronized with the imaging scanner as needed.

The controlled air heater system of the present invention preferably employs at least one air heater (50). The air heater (50) also includes and functions as an air dryer (20), air compressor (30), and heat controller (40), which is coupled to manifolds (60). The manifolds (60) are configured to facilitate the focus and control of the heat such that it is applied in a uniform fashion (or to a preset thermal profile) at the directed target all along the conveyor.

As shown in FIG. 1, the manifolds (60) are present within a conveyor compartment (70) conventionally disposed in communication with an imaging scanner. The sampler of the present invention may be integrated in one of several ways: 1) The system of the present invention may be integrated into conventional conveyor compartments which have adequate space for the manifolds (60), evaporators (80), and the vapor collectors (110) of the present invention. Sampler size and configuration of the present invention may be adjusted to the to the conveyor system due to the segmental construction of the sampler. 2) The system of the present invention may be integrated over a conveyor on which items are moving, not necessarily for security, but for chemical manufacturing industries to ensure and maintain consistency of the product. In such cases, no size adjustment to an imager is required. 3) Finally, the system of the present invention may be installed as a stand-alone operation, without integration into an imaging scanner or even a conveyor if desired.

The controlled evaporation system of the present invention employs at least one evaporator (80) disposed in communication with a power source (90). The at least one evaporator (80) is preferably dispersed all along the space of the conveyor, covering the surfaces of items as they traverse a belt or rollers of the conveyor. The air heater system is configured to supplement the at least one evaporator (80) of the present invention to facilitate the creation of vapors derived from the object within the conveyor compartment (70). The primary advantage and novelty of the system of the present invention is that it facilitates the rapid evaporation of chemicals which are conventionally difficult to evaporate. This action is conducted via the rapid evaporation system of the at least one evaporator (80), whereby heated air is configured to only support the evaporation, creating a uniform thermal field, providing vapors when very volatile chemicals are to be detected. At least one radiation source (100) is preferably employed to enable the at least one evaporator (80) to enable adequate creation of the requisite vapors. (Conventionally, the number of radiation sources, referenced as radiators, is adjusted to the dimensions of the conveyor, as well as the dimensions of the items traversing the conveyor.) The radiation source (100) is preferably elected in a range of frequencies which is optimal for the searched molecules (traces) to which the client wishes to detect. In the case of energetic materials, the range of frequencies differs from the range of frequencies which would affect the polymers of conventional luggage, bags, jackets, shoes, and other conventionally scanned personal belongings, preventing damage or deterioration to the objects themselves. The wattage of the radiation source (100) preferably varies between 500 W to 2500 W.

The vapors are then collected by negative pressure suction via vapor collectors (110) disposed subsequent from the manifolds (60) of the controlled air heater system of the present invention. The trace collectors' manifolds are preferably located on the interior walls of the conveyor system, all along the conveyor, and are spread out equally within the space available. The air heater manifolds, as well as the evaporators, referenced as radiation source (110), are located on the interior side of the roof, directed downwards towards the conveyor. Therefore, the location of the trace collectors is not necessarily related to the location of the radiation source (100). The vapor collectors (110) are configured to direct the vapors collected to a conventional mass spectrometry trace detection system (detector (115)) automatically and continuously.

The heating of surrounding air efficiency increases with the volatility of the materials heated, usually expressed by melting and boiling temperatures. The heating via radiation provided by the radiation source (100) of the present invention is adjusted to the searched materials and is therefore not limited. It should be noted that materials with high volatility and extremely low volatility can be detected simultaneously via the system of the present invention when paired with a conventional detector system. Energetic materials are usually made from organic materials, but there are a few which are inorganic. Therefore, this concept can be widened to any application in which the presence of a material's trace (usually micrograms and smaller) presence is of importance to be detected. Further, this concept can be used for bulk quantities of objects as well; however, use of the system on a high number of objects (such as pharmaceuticals) requires reducing the amount of sample going to the detector.

There is no purging or reset times as the sampler operates continuously. The detector, at present a Mass Spectrometer, is preferably modified to be compatible with the system of the present invention. The mass spectrometry detector has only been adjusted to be able to work continuously. Therefore, the detector is configured to analyze the vapors collected in real-time with minimal delay in accordance with the movement of the conveyor belt. It is expected that other detection techniques in the near future will be able to be used with the system of the present invention in order to enable them to work continuously as well.

The sampling provided by the system of the present invention is directly done from the screened item surface and its surrounding atmosphere. Therefore, the vapors are not going through any preconcentration process which were found to be not in compliance with this new concept. Since the vapors flow directly from the item to the collectors and from them to the detector, no sample medium is required.

As previously noted, the luggage need not be opened for the system to function properly, but if it is opened, the sampler may operate the same way as when it is closed. A source of specific range of frequencies is used, per the radiation source (100), which was found suitable to evaporate the target molecules. To generate the heated air, a conventional air heating system is employed. The air heating system is preferably controlled to create a specific temperature profile which is also a unique feature of the present invention. The air is forced through many dies into the screened space of the housing of the conveyor, giving the user an ability to control the heated temperature profile within +/−one inch. The vapors flow directly from the sampler to the detector. It is a direct transfer of vapors from the conveyor housing to the detector via the vapor collectors.

Figure 2:
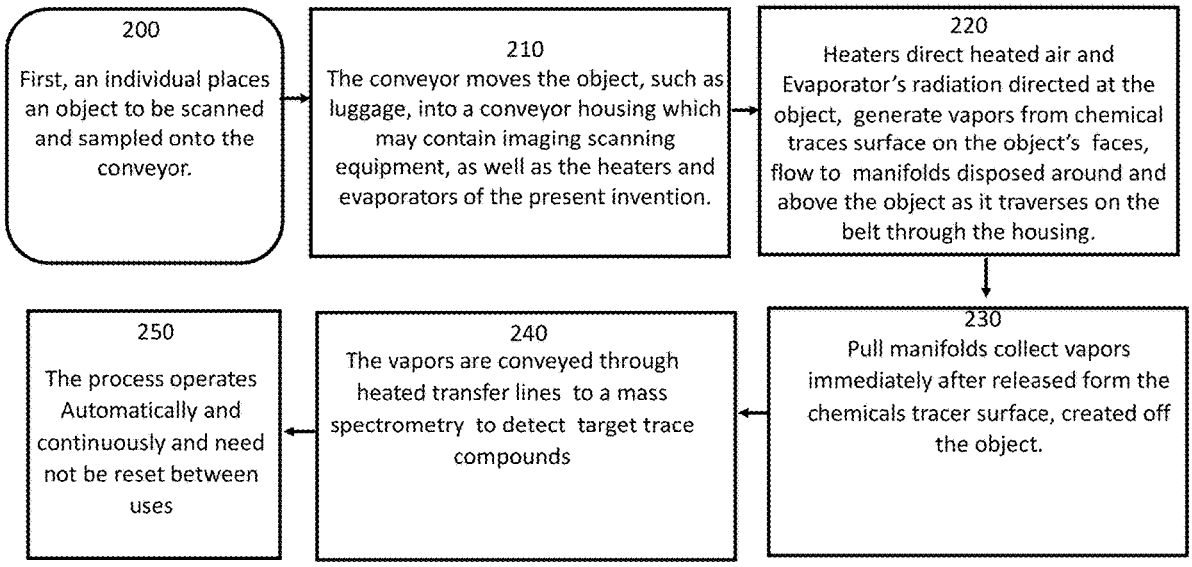
FIG. 2 exhibits a flow chart detailing the process of use of the present invention.

The process of use of the apparatus of the present invention by a user, as seen in FIG. 2, is preferably as follows:

1. First, an individual places an object to be scanned and sampled onto the conveyor. (200)
2. The conveyor moves the object, such as luggage, into a conveyor housing which may contain imaging scanning equipment, as well as the heaters and evaporators of the present invention. (210)
3. Heaters direct heated air and radiation from the evaporators at the object, generating vapors from chemical traces surface on the objects' faces, which flow to manifolds disposed around and above the object as it traverses on the belt through the housing. (220)
4. Pull manifolds collect vapors immediately after released from the chemical's tracer surface, created off the object. (230)
5. The vapors are conveyed through heated transfer lines to a mass spectrometry detector to detect for target trace compounds conventionally. (240)
6. The process operates automatically and continuously and need not be reset between uses. (250)

It should be understood that some embodiments of the present invention may be used in different contexts and locations. The sampler can be used in many applications. For example, the system may be employed in security (explosives, narcotics, and chemical agents), and/or chemical and electrical industries where the purity and/or the cleanliness of conveyed items must be analyzed continuously. This is also true for pharmaceutical lines where the capsules are moving on conveyors before being packed. In each of these applications, detectors are presently employed, but the sampling is made manually, adding labor cost and delays to the process.

It should be noted that the speed of the process enacted by the system of the present invention depends on the size of area under test. Larger areas to scan and sample from take more time to complete. In addition, the kind of materials and number of materials to be evaporated may increase the response time of the system. If the evaporation is conducted in an open vs. closed system, the evaporation time will inherently be longer. To achieve successful evaporation, the amount of trace and its exposed area must be over a certain limit. However, it should be understood that the trace amount reflects limitations of the detector employed with the system, rather than the evaporator (80) itself.

Further, it should be understood that the system of the present invention is modular such that the transfer speed of the sample collected vapors may be varied in accordance with the needs of the operation at hand. Therefore, the sampling rate and transfer speed, as well as other variables, may be adjusted as needed.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. An enhanced trace sampling method for use in tandem with a mass spectrometry detector equipped with a conveyor comprising:

placing an object in the conveyor for trace sampling;

wherein the conveyor contains imaging scanning equipment, air heaters, and evaporators;

wherein the evaporators are equipped with a radiation source;

the air heaters directing heated air at the object from above the conveyor, wherein the heated air creates a uniform thermal field;

the evaporators directing radiation at the object from above the conveyor, the radiation generating vapors from chemical traces of volatile organic compounds on the surface of the object as the object traverses on the belt through the conveyor;

manifolds collecting trace vapors immediately after they are released from the surface of the object;

heated transfer lines conveying the vapors to the mass spectrometry detector; and the mass spectrometry detector detecting for target trace compounds.

2. The enhanced trace sampling method of claim 1, wherein the manifolds employ negative pressure suction present within vapor collectors of the manifolds.

3. The enhanced trace sampling method of claim 1, wherein the air heaters provide forced heated air disposed directionally towards the object.

4. The enhanced trace sampling method of claim 1, wherein the number of radiation sources, is adjusted to dimensions of the conveyor, as well as the dimensions of the object traversing the conveyor.

5. The enhanced trace sampling method of claim 1, wherein the wattage of the radiation source preferably varies between 500 W to 2500 W.

* * * * *